US005494567A

United States Patent [19]

Tamaki

[11] Patent Number: 5,494,567

[45] Date of Patent: Feb. 27, 1996

[54] PROCESS FOR PRODUCING CARBON MATERIALS

[75] Inventor: Toshio Tamaki, Kamisumachi, Japan

[73] Assignee: Petoca Ltd., Tokyoto, Japan

[21] Appl. No.: 330,607

[22] Filed: Oct. 28, 1994

Related U.S. Application Data

[63] Continuation of Ser. No. 15,889, Feb. 10, 1993, abandoned, which is a continuation of Ser. No. 698,864, May 13, 1991, abandoned, which is a continuation-in-part of Ser. No. 351,128, May 12, 1989, abandoned.

[30] Foreign Application Priority Data

May 14, 1988 [JP] Japan ..... 63-117487

[51] Int. Cl.[6] ..... C10C 3/02

[52] U.S. Cl. ..... 208/44; 208/22; 208/39; 423/447.2; 423/447.6

[58] Field of Search ..... 208/22, 39, 44; 423/449, 447.2, 447.6

[56] References Cited

U.S. PATENT DOCUMENTS

| | | | |
|---|---|---|---|
| 4,146,576 | 3/1979 | Wyss | 208/44 |
| 4,414,095 | 11/1983 | Dickakian | 208/44 |
| 4,431,513 | 2/1984 | Lewis | 208/44 |
| 4,457,828 | 7/1984 | Lewis | 208/39 |
| 4,488,957 | 12/1984 | Noguchi et al. | 208/44 |
| 4,715,945 | 12/1987 | Dickakian | 208/44 |
| 4,789,455 | 12/1988 | Mochida et al. | 208/44 |
| 4,891,126 | 1/1990 | Mochida et al. | 208/39 |

FOREIGN PATENT DOCUMENTS

| | | | |
|---|---|---|---|
| 0891474 | 1/1972 | Canada | 208/44 |
| 0016661 | 10/1980 | European Pat. Off. | 208/44 |
| 0067581 | 12/1982 | European Pat. Off. | 208/44 |
| 0072242 | 2/1983 | European Pat. Off. | 208/44 |
| 0090475 | 10/1983 | European Pat. Off. | 208/44 |
| 0168358 | 1/1986 | European Pat. Off. | 208/44 |
| 1181664 | of 1974 | Japan . | |
| 0093786 | 6/1983 | Japan | C10C 3/00 |
| 8093786 | 6/1983 | Japan | C10C 3/00 |
| 2025193 | 2/1987 | Japan | C10C 3/08 |
| 2054787 | 3/1987 | Japan | C10C 3/02 |

*Primary Examiner*—Helane Myers

*Attorney, Agent, or Firm*—Armstrong, Westerman, Hattori, McLeland & Naughton

[57] ABSTRACT

A process for producing an optically isotropic reformed pitch useful for various carbon materials is provided. This process comprises mixing a pitch having a ratio of aromatic hydrocarbon fa of more than 0.6 with a strong Lewis acid and a co-solvent so as to give a mol ratio of the said Lewis acid to the said pitch in the range of 0.3~5.0 and a mol ratio of the said co-solvent to the said pitch in the range of ratio of 2.5~50, reacting the mixture at a temperature of 100°~300° C. and removing the Lewis acid and the co-solvent from the reaction product. Meso-Carbon microbeads having a uniform diameter of 20 μm or less can be produced at a high yield of 60% or more by heat treating the said reformed pitch at 200°~380° C. to produce the optically anisotropic small spheres and separating them from an optically isotropic matrix.

5 Claims, No Drawings

PROCESS FOR PRODUCING CARBON MATERIALS

CROSS REFERENCE TO RELATED APPLICATION

This application is a continuation of application Ser. No. 08/015,889, filed Feb. 10, 1993, now abandoned, which is a continuation of application Ser. No. 07/698,864, filed May 13, 1991, now abandoned, which is a continuation-in-part of application Ser. No. 07/351,128, filed May 12, 1989, now abandoned.

BACKGROUND OF THE INVENTION

1. Field of Arts

This invention relates to a process for producing an optically isotropic reformed pitch useful for various carbon materials by reacting a pitch in the presence of a strong Lewis acid and a co-solvent. Since the said reformed pitch has a characteristic property that it has a high fixed carbon content in spite of its low softening point and low quinoline insoluble content and that it can be converted easily to mesophase by heat treatment, the said reformed pitch can be used for various purposes, for example, an impregnant for high grade carbon materials such as carbon-carbon composite materials, artificial graphite electrodes, carbon graphite shaped articles, etc., a raw pitch for mesophase pitch based carbon fibers, and a mixing material for modifying various kinds of pitch.

This invention also relates to a process for producing spherical meso-carbon microbeads which comprises subjecting the said reformed pitch to a heat treatment at a temperature of 200°~380° C. Further, this invention relates to a process for producing meso-carbon microbeads having a uniform diameter in the range of 0.5~20 μm, at a high yield of about 60% or more.

Meso-carbon microbeads are spherical carbon materials having a structure in which highly condensed polycyclic aromatic hydrocarbons are arranged in a definite direction. Since meso-carbon microbeads have properties inherent to carbon chemically, electrically and magnetically and have a good sintering property during carbonization, they are used for various industrial materials such as an electro conductive filler, a binderless isotropic high density carbon material, a catalyst carrier a chromatogram filler, etc., in the form of meso-carbon microbeads as they are produced or after carbonization.

2. Prior Art

High grade carbon materials such as carbon-carbon composite materials, artificial graphite electrodes, carbon-graphite shaped articles, etc. are generally produced by shaping, carbonizing and graphitizing a mixture of a basic material such as shaped cokes and a binder pitch. In the case of producing a high density, high strength material, it is necessary to repeat pitch impregnation and carbonization process several times before graphitization. The impregnant is indispensable for producing a high grade carbon material, because the pitch impregnation of a carbonized material is effective to bind the basic materials with each other, to decrease porosity and increase density, strength, electric conductivity and thermal conductivity of the produced carbon material.

Pitch based impregnants are generally produced from petroleum or coal based pitch by heat treating to cause a condensation polymerization reaction and to remove a low boiling point fraction.

Pitch based impregnants are required to have properties as follows for various purposes.

(1) Low quinoline insoluble (QI) content (2) Low softening point (3) High fixed carbon content (4) High resin content (difference between benzene insoluble content and QI content)

(5) Low ash content (6) Low content of low boiling point fraction

Among these properties, low QI, low softening point and high fixed carbon content are very important.

According to the conventional production process of pitch based impregnants, if the softening point were lowered to improve an impregnation efficiency, the fixed carbon content would extremely decrease, therefore, a pitch impregnation and carbonization process would have to be repeated several times. While if the fixed carbon content were raised to decrease the number of repetitions of pitch impregnation and carbonization, the impregnation efficiency would extremely decrease because of the increase of the QI content and the elevation of the softening point, and a solvent extraction process would be necessary to remove quinoline insoluble components.

According to the conventional production process of meso-carbon microbeads, the production of meso-carbon microbeads having a very small diameter, particularly 5 μm or less has been difficult.

Further, there is a problem in that if it is intended to increase the yield of optically anisotropic small spheres, the small spheres coalesce and precipitate to produce bulk mesophase and separation of small spheres becomes difficult.

Some arts disclose the modification of product quality by coexistence of a Lewis acid in converting pitches to mesophase. Official gazette of patent publication Sho 53-7533 discloses a process for producing a mesophase pitch having a softening point of 200°~300° C. which comprises directly adding a solid Lewis acid such as $AlCl_3$ or the like to a petroleum based tar or pitch having a softening point of 120° C. or lower, subjecting the resulting mixture to heat treatment at a temperature higher than the softening point of the said mixture, usually at 200°~300° C., and after removing the catalyst, subjecting to the second heat treatment at a temperature of 350°~500° C.

Since the flow characteristic of non-mesophase component is close to that of mesophase component in this mesophase pitch, spinnability is excellent even when mesophase content is low and it is said that this mesophase pitch is preferable as a raw material of carbon fibers. However, the temperature of the first heat treatment should be kept high to perfectly melt the solid Lewis acid. There is no disclosure about the production of meso-carbon microbeads.

In U.S. Pat. No. 4,457,828, there is disclosed a mesophase pitch having molecules of ellipsoidal shape which are produced by the polymerization of aromatic hydrocarbon containing two or more condensed rings. The molecules of this mesophase pitch have been polymerized as 60% or more of bonds which connects condensed rings are coupling (bonding which does not form ring closure) and have a long and slender shade as a whole and considered to be close to ellipsoid.

This polymerization reaction is carried out using a catalyst of a weak Lewis acid such as an anhydrous $AlCl_3$ accompanied by a second component such as $CuCl_2$ which has a function of reducing the activity of $AlCl_3$. As a solvent, orthodichlorobenzene, nitro benzene and trichlorobenzene are preferable. It is said that the mesophase pitch which is obtained by subjecting a pitch, from which a catalyst has been removed, to heat treatment is preferable for spinning probably due to its slender molecule. Further, this mesophase pitch has a low softening point and good shaping property at a low temperature. It is said that this mesophase pitch has a thin laminate layer of molecule compared with conventional mesophase pitches in spite of high completeness of crystal formation. Further, it is said that this mesophase pitch has characteristic properties different from the mesophase pitch produced by using a strong Lewis acid which is not accompanied by the second component. According to this process, the control of the catalyst system is complicated and the growth of mesophase is restrained. There is no disclosure about the production of meso-carbon microbeads.

As for a process for producing meso-carbon microbeads, as disclosed in e.g. in official gazette of patent publication No. Sho 50-39633, a process in which petroleum based or coal based pitch is subjected to heat treatment at a temperature of 350°–500° C. at a relatively slow heating rate (10° C./min. or less), has been heretofore carried out.

The problem of this process is in the difficulty of production of meso-carbon microbeads having uniform diameter with a high yield. Even when good quality pitch containing no free carbon was used as a raw material, yield was 10 vol % or less.

In the production of meso-carbon microbeads, it is considered that if the temperature in the inside of a reactor is made uniform, and by-product lower boiling point components are discharged efficiently to the outside of a system, long reaction time can be shortened. Official gazette of patent publication No. Sho 53-9599 discloses an art of producing meso-carbon microbeads in which a pitch in a reactor is heated by blowing superheated steam and vigorous stirring is carried out at the same time to produce optically anisotropic small spheres within a relatively short period of time and meso-carbon microbeads are produced from the said reaction product.

The problem of this art is that it is difficult to prevent the optically anisotropic small spheres from colliding and coagulating with each other. In this patent, the yield of optically anisotropic small spheres is suppressed at a low value a little over 10%. On this account, there is a problem that the amount of discarded pitch increase, resulting in high cost.

As for a process for producing meso-carbon microbeads having a uniform diameter, official gazette of patent publication Sho 59-17043 discloses heat treatment of pitch is carried out twice in order to obtain optically anisotropic small spheres. In this process, optically anisotropic small spheres which precipitates at the second heat treatment are removed and only floating optically anisotropic small spheres after the second heat treatment are picked up to make uniform the diameter of the small spheres and to acquire only small spheres having high degree of perfect circularity. It is said that the meso-carbon microbeads obtained according to this process are excellent in the quality such as uniformity of diameter and degree of perfect circularity and are convenient to be used. But, the yield of meso-carbon microbeads from a raw material pitch is still about 10% and high cost is a problem.

It is an object of the present invention to produce a low softening point, low QI content and high fixed carbon content optically isotropic reformed pitch useful for various carbon materials.

It is another object of the present invention to overcome the problem of conventional process for producing meso-carbon microbeads, i.e. low yield and high cost and to produce meso-carbon microbeads having a uniform diameter of 20 μm or less with a high production yield of about 60% or more by suppressing the coalescence and precipitation of optically anisotropic small spheres during heat treatment of pitches.

SUMMARY OF THE INVENTION

The present invention resides in a process for producing an optically isotropic reformed pitch useful for carbon materials which comprises mixing a pitch having an aromatic carbon ratio fa of more than 0.6, with a strong Lewis acid and a co-solvent, which dissolve both the said pitch and the said Lewis acid and promote a reaciton in the liquid state, so as to give a mol ratio of the said Lewis acid to the said pitch in the range of 0.3~5.0 and a mol ratio of the said co-solvent to the said pitch in the range of 2.5~50, reacting the mixture at a temperature of 100°–300° C. and removing the said Lewis acid and the co-solvent from the resulting reaction product.

DESCRIPTION OF THE PREFERRED EMBODIMENTS

The pitch used in the process of the present invention is selected from those having an aromatic carbon ratios fa (ratio of carbon forming aromatic rings to the total carbon) of more than 0.6. It is preferable that the pitch is a petroleum or coal based high boiling point fraction, but the use of a low boiling point raw material is also allowable.

There is no particular problem about the use of a raw material having a boiling point in the extent of gas oil or kerosene. As a raw material, a single or mixed use of a pure material having a high aromatic carbon ratio, e.g. naphthalene, anthracene, phenanthrene, etc. is possible.

The strong Lewis acid catalysts used in the present invention are those such as $BF_3$ or $HF.BF_3$, anhydrous $AlCl_3$, anhydrous $CuCl_2$, anhydrous $ZnCl_2$ or anhydrous $SnCl_2$.

From the point of forming velocity of microbeads, anhydrous $AlCl_3$ is preferable, but in case where complete removal of a catalyst from a reaction product is necessary, a vaporizable catalyst is preferable. Particularly, $HF.BF_3$ is preferable since HF increases the function of the catalyst, and effectiveness as a solvent can be expected for limited raw materials and recovery and re-use are easy.

The co-solvents used in the present invention are those compounds which have a boiling point preferably in the range of 100°~350° C. and most preferably in the range of 150°~250° C. and which do not cause a reaction such as decomposition of Lewis acid and are easily separable from the reaction product. The co-solvents are preferably aromatic compounds having a neutral or an acidic substituent and most preferably, compounds in which one or more compounds selected from the group consisting of dichlorobenzene, nitrobenzene, trichlorobenzene are principal components. Even basic compounds such as pyridine, quinoline or the like, which react with the Lewis acid, but does not destroy the structure of the Lewis acid and does not form water by neutralization, are usable because they only weaken the catalytic effect.

When a co-solvent is present various kinds of effect can be obtained.

First of all, since the co-solvent dissolves both a pitch and a strong Lewis acid, both contact in the liquid state, an efficiency of reaction is increased and uniform optically isotropic reformed pitch can be obtained.

Further since even a pitch having a high softening point such as 250° C. can be used as a raw material if the pitch dissolves in a co-solvent, selection of a raw material can be varied flexibly depending upon the required quality of product. Particularly in case of $HF.BF_3$ without a co-solvent, a raw material having a high softening point cannot be used because of limitative dissolving power of HF. Further, as the amount of HF becomes greater, the reaction system turns to high pressure and separation and recovery of HF becomes difficult, but if a co-solvent is present, the amount of HF can be greatly reduced and reaction temperature can be lowered. Namely, even a high softening point pitch can be turned to a liquid state at a lower temperature by dissolving in a co-solvent. In case of $AlCl_3$, since melting point is about 190° C., if it is to be turned to a complete liquid state, the reaction temperature must be higher than this, but if a co-solvent is present, it is possible to turn to liquid state at a lower temperature.

A mixing ratio of a pitch, a strong Lewis acid and a co-solvent is preferably in the range of 1:0.3~5:2.5~50. In case of $HF.BF_3$, the amount of HF should be removed in the above mentioned ratio. Reaction temperature is in the range of 100°~300° C., preferably 120°~250° C. Reaction time is preferably in the range of 1~30 hours. In case of $HF.BF_3$, it is preferable that 0.3~1.0 mol of $BF_3$ and 1~5 mol of HF are present relative to 1 mol of pitch and reaction time is 1~5 hours, and even at a reaction temperature of 100° C. a uniform optically isotropic reformed pitch can be obtained. Reduction of the ratio of strong Lewis acid to less than 0.3 is not preferable because reaction yield is reduced. If the ratio of strong Lewis acid is more than 5.0, the increase of reaction velocity becomes small and on the one hand the time necessary to remove the Lewis acid from a reaction product becomes longer and this causes increase of cost and hence is not preferable. Reaction temperature lower than 100° C. is not preferable because reaction yield from a pitch is extremely reduced.

Further if reaction temperature is elevated over 300° C. local rapid reactions tend to occur and the uniformity of the optically isotropic reformed pitch is lowered, and as for meso-carbon microbeads, optically anisotropic small spherical become liable to coalesce and associate during the heat treatment and diameters of small spheres become non-uniform.

A reaction time less than one hour provides generally low yield from a pitch. On the one hand even when reaction is carried cut over 30 hours, the reaction yield from the pitch scarcely increases and the yield of optically anisotropic small spheres after heat treatment does not increase almost at all and no notable change occurs on the quality of meso-carbon microbeads and accordingly not advantageous in the point of cost.

After the reaction of the pitch in the presence of a co-solvent and a strong Lewis acid, the co-solvent and the Lewis acid are removed from the reaction system. In case of the solid Lewis acid, removal of the co-solvent is preferably carried out by vacuum distillation. It is preferable to carry out the operation in the inert gas atmosphere. The removal of the Lewis acid is preferably carried out by extraction with an aqueous solvent. Particularly, repetition of washing with a dilute hydrochloric acid is effective. In case of a vaporizable Lewis acid, purging by an inert gas or vacuum distillation is preferable to remove the co-solvent and the Lewis acid from the reaction system, followed by trapping thereof. It is preferable to re-use the co-solvent or the Lewis acid.

The properties of the produced optically isotropic reformed pitch fairly depend on the raw pitch. In the case of a raw pitch having a softening point of about 250° C., produced reformed pitch has a softening point of about 270° C., a quinoline insoluble content of about 5 wt % and a fixed carbon content of about 90 wt %. In the case of a raw pitch having a softening point of about 100° C., produced reformed pitch has a softening point of about 140° C., a quinoline insoluble content of less than 1 wt % and a fixed carbon content of about 70 wt %, and the optically isotropic reformed pitch can be easily converted to 100% mesophase by a heat treatment in less than 2 hrs. This optically isotropic reformed pitch is very suitable for an impregnation pitch of carbon materials, because high density, high strength carbon materials can be easily produced.

The mesophase obtained by heat treatment of the optically isotropic reformed pitch of the present invention has a conventional flow type structure and the increase of the softening point by the heat treatment is small. This mesophase is suitable for a spinning pitch to make a high performance carbon fiber, because 100% mesophase pitch having a softening point of less than 270° C. can be produced. Particularly, a reformed pitch produced by a vaporizable Lewis acid is preferable as raw pitch of the carbon fiber, because there is no residual catalyst.

The optically isotropic reformed pitch of the present invention is also used to modify a conventional petroleum or coal based pitch. When a mesophase containing pitch produced from a Fitch having an aromatic carbon ratio fa of more than 0.6 is heat treated, the mesophase content can be increased, but at the same time the softening point is also raised to the extent which is unsuitable for spinning to make a carbon fiber. While it is found out that when the mesophase containing pitch is mixed with the optically isotropic reformed pitch of the present invention and the mixture is heat treated, the resulting pitch has a low softening point and a high mesophase content and is useful for spinning to make a carbon fiber because the conversion rate to mesophase is increased and the increase of the softening point is suppressed. Further, when essentially 100% mesophase pitch is mixed with the reformed pitch and the mixture is heat treated, the resulting pitch is a 100% mesophase pitch having a lowered softening point.

By heat treating the optically isotropic reformed pitch of the present invention at a temperature of 200°~380° C. and separating produced optically anisotropic small spheres from an optically isotropic matrix, meso-carbon microbeads having a uniform diameter in the range of 0.5~ 20 μm can be obtained at a high yield of about 60 wt % or more.

For the control of the diameter of the optically anisotropic small spheres, the change of temperature at the time of heat treatment of the reformed pitch is most effective.

The relation of the heat treatment temperature and mean diameter varies according to the conditions such as kind of a pitch, mol ratio of a strong Lewis acid or the like. In case of a reformed pitch produced in the presence of $AlCl_3$, (mol ratio 1.35), a heat treatment temperature of 250° C. or lower is advantageous to the formation of a mean diameter less than 1 μm. A temperature of 250°–300° C. is advantages to the formation of a mean diameter of 1~5 μm and a temperature of 300°~350° C. is advantageous to the formation of a mean diameter of 5~20 μm. In case of $HF.BF_3$, there is a tendency of requiring slightly higher temperature than that in case of $AlCl_3$.

As for a process of picking up the optically anisotropic small spheres from the reaction product which has finished heat treatment, it is preferable to extract the remaining isotropic matrix by a solvent. Separation using difference of specific gravity of liquid phase after solidifying only the optically anisotropic small spheres by way of lowering temperature is also possible, but the isotropic matrix is liable to adhere to the small spheres. Though yield is superior, the quality is not necessarily good.

As a solvent used to extract the optically anisotropic small spheres, quinoline has been used in most cases. In the case of the present invention, since solubilities of the resulting optically anisotropic small spheres and the isotropic component of matrix are both superior, if quinoline is used, yield of the small spheres becomes lower. For the solvent used in the extraction of the optically anisotropic small spheres of the present invention, it is preferable to use toluene or those having a solubility close to toluene such as benzene, xylene, trichlorobenzene, nitrobenzene, o-dichlorobenzene.

Following examples are presented to illustrate the process of the present invention, but they are not intended to limit the scope of the invention.

EXAMPLE 1

A petroleum based pitch (having an initial distillation fraction of 460° C. and a final distillation fraction of 560° C.) produced as a by-product of Fluid catalytic cracking (F.C.C.) of desulfurized vacuum gas oil (DVGO) and having a softening point of 72° C. (Mettler softening point measuring apparatus is used) and a number average molecular weight of 400 was taken in an amount of 200 g and put into glass round bottom flask, 90 g of anhydrous $AlCl_3$ as a strong Lewis acid catalyst, 1000 ml of o-dichlorobenzene as a co-solvent were added and reaction was carried out at a temperature of 180° C. under reflux of the solvent for 26 hours. (Mol ratio of the pitch, Lewis acid and compatible co-solvent were 1:1.35:17.65).

After completion of the reaction, the solvent was removed by vacuum distillation under nitrogen atmosphere, whereby a solid residual product was obtained. This solid residual product was washed with distilled water and 1N dilute hydrochloric acid and anhydrous $AlCl_3$ was removed by hydrolysis, whereby a reformed pitch was obtained. This pitch form product was obtained nearly in the same amount with the raw material pitch before reaction. The softening point of this reformed pitch was 176° C. The reformed pitch was observed with a polarization microscope to be optically isotropic.

This pitch in an amount of 100 g was introduced into a stainless steel reaction vessel having an inner volume of 500 ml. While flowing nitrogen in a flow rate of 2 Nl/min. and with stirring at 300° C., heat treatment was carried out for 30 minutes to obtain a pitch product. Yield was 98 wt % relative to the raw reformed pitch.

When the pitch product was observed with a polarization microscope, it was found that this product contained optically anisotropic small spheres having a mean diameter of 3~5 μm. This pitch product was dissolved in trichlorobenzene and separated by filtration whereby as insoluble portion meso-carbon microbeads were obtained with a yield of 62 wt %.

EXAMPLE 2

The optically isotropic reformed pitch of Example 1 was subjected to heat treatment at a temperature of 330° C. for 60 minutes, whereby yield of resulting pitch product was 95 wt %. A mean diameter of optical anisotropic small spheres contained therein was 6.2 μm. The yield of resulting meso-carbon microbeads as an insoluble portion in trichlorobenzene was 80 wt %.

EXAMPLE 3

The heat treatment temperature of the optically isotropic reformed pitch of Example 1 was set to 250° C. and heat-treatment time was set to 60 min. The yield of resulting pitch product was 98 wt % and a mean diameter of contained optically anisotropic small spheres was 0.7 μm and the yield of meso-carbon microbeads obtained as trichlorobenzene insoluble portion was 65 wt %.

EXAMPLE 4

A petroleum based pitch produced as a by-product of F.C.C. of DVGO and having a softening point of 130° C. and a number average molecular weight of 500 was reacted in the presence of anhydrous $AlCl_3$ and o-dichlorobenzene (mole ratios were same as in Example 1) at 180° C. under reflux of the solvent for 26 hours.

After completion of the reaction, anhydrous $AlCl_3$ and o-dichlorobenzene were removed as in Example 1 and an optically isotropic reformed pitch having a softening point of 195° C. was obtained at a yield of about 100%.

This reformed pitch was heat treated at 250° C. for 60 minutes to obtain a pitch product at a yield of 98 wt %. A mean diameter of contained optically anisotropic spheres was 4.6 μm and the yield of meso-carbon microbeads obtained as trichlorobenzene insoluble portion was 69 wt %.

Comparative Example 1

The raw material pitch of Example 1 was introduced immediately into a stainless steel reaction vessel without carrying out a reaction using a strong Lewis acid catalyst. While flowing nitrogen at a flow rate of 2 Nl/min. and with stirring, heat treatment was carried out at 380° C. for 12 hours whereby a pitch product was obtained. The yield was 92 wt % relative to the raw pitch. When this pitch product was treated with trichlorobenzene as in Example 1, solubility of isotropic pitch was poor and isolation of meso-carbon microbeads was difficult. This pitch product was dissolved in quinoline in place of trichlorobenzene and separation was carried out by filtration. Meso-carbon microbeads were obtained as an insoluble portion with a yield of 16.3 wt %.

EXAMPLE 5

The optically isotropic reformed pitch of Example 1 which had been subjected to the treatment using the strong Lewis acid in the co-solvent and from which the Lewis acid and the co-solvent had been removed by washing was subjected to heat treatment at 420° C. for one hour, whereby a pitch of substantially 100% conventional flow type mesophase was obtained.

EXAMPLE 6

A coal based pitch having a softening point of 86.3° C. (Mettler softening point measuring apparatus is used), toluene insoluble content of 20.9 wt %, quinoline insoluble content of 0.3 wt %, and a mean molecular weight of 450, was taken in an amount of 200 g and put into a glass, round bottom flask (capacity 2000 ml), 90 g of anhydrous $AlCl_3$ as a strong Lewis acid catalyst, and 1000 ml of o-dichlorobenzene as a co-solvent were added and reaction was carried out at 180° C. under reflux of the solvent for 26 hours. (Mol ratio of the pitch, Lewis acid and co-solvent was 1:1.52:20).

After completion of the reaction, the solvent was removed by vacuum distillation in nitrogen atmosphere and a solid residual product was obtained. This solid residual product was washed with water and 1N dilute hydrochloric acid. The anhydrous $AlCl_3$ was removed by hydrolysis and an optically isotropic reformed pitch form product was obtained. The softening point of this reformed pitch was 180° C.

This reformed pitch in an amount of 100 g was introduced into a 500 ml stainless steel reactor. While flowing nitrogen at a flow rate of 2 Nl/min. and with stirring, heat treatment was carried out at 340° C. for 60 minutes to obtain a pitch product. Yield was 95 wt % relative to the raw reformed pitch.

When the pitch product was observed with a polarization microscope, it contained optically anisotropic small spheres having a mean diameter of 8.2 μm. When this pitch product was dissolved in trichlorobenzene and insoluble product was separated by filtration, meso-carbon microbeads were obtained with a yield of 73 wt %.

EXAMPLE 7

By using the petroleum based pitch of Example 1 and changing the kinds, ratios of strong Lewis acid and co-solvent, reactions were carried out. From the optically isotropic reformed pitch obtained after removing the Lewis acid and the co-solvent, optically anisotropic small spheres were produced and meso-carbon microbeads were prepared. The reaction conditions and the characteristic properties of products are shown in Table 1.

EXAMPLE 8

A petroleum pitch (initial distillation fraction of 460° C. and final distillation fraction of 560° C.), produced as a by-product of fluid catalytic cracking process (F.C.C.) of desulfurized vacuum gas oil, having a softening point of 72° C. (Mettler softening point measuring apparatus was used) and an average molecular weight of 400, in an amount of 0.5 mols was introduced into a 500 ml stainless steel autoclave, 1.25 mols o-dichlorobenzene was added, after dissolving, the content was cooled till 5° C. Then, under cooled state, 2.5 mols HF was introduced and after the autoclave was purged with nitrogen, 0.5 mols $BF_3$ was blown in. The temperature was elevated at a heating rate of 3° C./min. and reaction was carried out at 180° C. for 2 hours. After completion of the reaction, cooling was carried out till room temperature was reached. While purging with $N_2$, temperature was elevated till 200° C., o-dichlorobenzene and $HF.BF_3$ were removed to the outside of the system at the same time, and were trapped. A reformed pitch was taken out after removal operation of o-dichlorobenzene and $HF.BF_3$. The yield of the reformed pitch was 100%. The softening point of the reformed pitch was 114° C. The reformed pitch was observed with a polarization microscope to be optically isotropic.

Resulting reformed pitch in an amount of 50 g was introduced into a 350 ml stainless steel reactor. While flowing nitrogen at a flow rate of 2 Nl/min. and with stirring, heat treatment was carried out at 350° C. for one hour to obtain a Fitch product. The yield of the pitch was 97 wt % relative to the reformed pitch. The mean diameter of optically anisotropic small spheres contained therein was 7.6 μm.

This pitch product was dissolved in trichlorobenzene and filtered off and meso-carbon microbeads were obtained with a yield of 65 wt %, as an insoluble portion.

TABLE 1

| | Reaction condition and characteristic properties of product | | | | | | | | | |
|---|---|---|---|---|---|---|---|---|---|---|
| | Lewis acid | | co-solvent | | reaction | | heat treatment | | product | |
| No. | kind | mol ratio | kind | mol ratio | temperature (°C.) | time hr. | temperature (°C.) | time hr. | diameter μm | yield % |
| 1 | $AlCl_3$ | 0.5 | OCB | 3.0 | 180 | 26 | 300 | 1 | 1 | 40 |
| 2 | $AlCl_3$ | 0.5 | OCB | 3.0 | 180 | 26 | 340 | 1 | 5 | 60 |
| 3 | $AlCl_3$ | 0.5 | OCB | 6.8 | 180 | 26 | 300 | 1 | 1 | 30 |
| 4 | $AlCl_3$ | 0.5 | OCB | 6.8 | 180 | 26 | 340 | 1 | 3 | 50 |
| 5 | $AlCl_3$ | 1.0 | OCB | 6.8 | 180 | 26 | 320 | 1 | 2 | 60 |
| 6 | $AlCl_3$ | 1.0 | OCB | 6.8 | 180 | 26 | 340 | 1 | 5 | 65 |
| 7 | $AlCl_3$ | 2.0 | OCB | 13.6 | 180 | 26 | 300 | 1 | 5 | 70 |
| 8 | $AlCl_3$ | 2.0 | OCB | 13.6 | 180 | 26 | 340 | 1 | 7 | 70 |
| 9 | $AlCl_3$ | 0.5 | NB | 8.1 | 211 | 10 | 300 | 1 | 3 | 50 |
| 10 | $AlCl_3$ | 0.5 | NB | 8.1 | 211 | 10 | 340 | 1 | 7 | 60 |
| 11 | $AlCl_3$ | 0.5 | NB | 8.0 | 211 | 15 | 210 | 5 | 0.4 | 30 |
| 12 | $AlCl_3$ | 0.5 | NB | 8.1 | 211 | 15 | 260 | 1 | 1 | 40 |
| 13 | $AlCl_3$ | 0.5 | NB | 8.1 | 211 | 15 | 300 | 1 | 3 | 50 |
| 14 | $AlCl_3$ | 0.5 | NB | 8.1 | 211 | 15 | 350 | 1 | 7 | 60 |
| 15 | $CUCl_2$ | 11.0 | OCB | 6.8 | 180 | 26 | 300 | 7 | 1 | 55 |
| 16 | $CUCl_2$ | 1.0 | OCB | 6.8 | 180 | 26 | 350 | 1 | 5 | 60 |

(symbol)
OCB: dichlorobenzener
NB: nitrobenzene

EXAMPLE 9

By using a petroleum based pitch having a softening point of 130° C. (Mettler softening point measuring apparatus was used) and a mean molecular weight of 500, which was a by-product of Fluid catalytic cracking (F.C.C.) of desulfurized vacuum gas oil, and changing the ratios of strong Lewis acid and co-solvent, reactions were carried out. From the pitch thus obtained after removing the Lewis acid and the co-solvent, optically anisotropic small spheres were produced and meso-carbon microbeads were prepared. The reaction conditions and the characteristic properties of products are shown in Table 2.

TABLE 2

| | Reaction condition of pitch using $HF.BF_3$ and characteristic properties of product | | | | | | | | | |
|---|---|---|---|---|---|---|---|---|---|---|
| | | | | | reaction | | heat treatment | | product | |
| | Lewis acid | | co-solvent | | temper- | | temper- | | dia- | |
| No. | kind | mol ratio | kind | mol ratio | ature °C. | time hr | ature °C. | time hr | meter μm | yield % |
| 1 | $BF_3$ | 0.9 | OCB | 2.5 | 120 | 3 | 250 | 3 | 1 | 50 |
| | HF | 5.0 | | | | | | | | |
| 2 | BF | 0.9 | OCB | 2.5 | 160 | 3 | 330 | 1 | 2 | 60 |
| | HF | 5.0 | | | | | | | | |
| 3 | BF | 0.9 | OCB | 2.5 | 180 | 3 | 330 | 1 | 4 | 70 |
| | HF | 5.0 | | | | | | | | |
| 4 | BF | 0.5 | OCB | 4.0 | 180 | 3 | 370 | 1 | 18 | 70 |
| | HF | 3.0 | | | | | | | | |
| 5 | BF | 0.5 | OCB | 4.0 | 180 | 3 | 350 | 1 | 7 | 65 |
| | HF | 3.0 | | | | | | | | |

(symbol) OCB: dichlorobenzene

EXAMPLE 10

A petroleum based pitch, as a by-product of Fluid catalytic cracking process (F.C.C.) of desulfurized vacuum gas oil, having a softening point of 130° C., (Mettler softening point measuring apparatus was used) a number average molecular weight of 500, in an amount of 6 mols was introduced into a stainless steel autoclave. 17.8 mols o-dichlorobenzene was added and after dissolving, the content was cooled to 5° C. Then, under cooled state, 12 mols HF was introduced. After the autoclave was purged with nitrogen, 6 mols $BF_3$ was blown in. Temperature was elevated at a heating rate of 1.5° C./min. and reaction was carried out at 160° C. for 3 hours.

While purging with $N_2$, temperature was elevated up to 200° C., o-dichlorobenzene and $HF.BF_3$ were simultaneously removed to the outside of the system and trapped. After the removing operation of the o-dichlorobenzene and $HF.BF_3$, a reformed pitch was taken out. The yield of the reformed pitch was 100%. Resulting reformed pitch had a softening point of 151° C. and was observed with a polarization microscope to be optically isotropic.

This reformed pitch was heat treated at 400° C. for 2.5 hours. The resulting pitch was 100% flow type mesophase having a softening point of 267° C. A carbon fiber was conventionally produced by spinning this resulting pitch at 285° C., infusiblizing and carbonizing at 2500° C. This carbon fiber had a tensile strength of 362 kgf/mm$^2$ and a modulus of elasticity of $77\times10^3$ kgf/mm$^2$.

EXAMPLE 11

A petroleum based pitch, as a by-product of Fluid catalytic cracking process (F.C.C.) of desulfurized vacuum gas oil, having a softening point of 200° C., (Mettler softening point measuring apparatus was used) a number average molecular weight of 598, in an amount of 5 mols was introduced into a stainless steel autoclave. 17.8 mols o-dichlorobenzene was added and after dissolving, the content was cooled to 5° C. Then, under cooled state, 25 mols HF was introduced. After the inside was purged with nitrogen, 5 mols $BF_3$ was blown in. Temperature was elevated at a heating rate of 1.5° C./min. and reaction was carried out at 160° C. for 3 hours.

After completion of the reaction, cooling to a room temperature was carried out. While purging with $N_2$, temperature was elevated up to 200° C., o-dichlorobenzene and $HF.BF_3$ were simultaneously removed at a reduced pressure to the outside of the system and trapped. After the removing operation of the o-dichlorobenzene and $HF.BF_3$, a reformed pitch was taken out. The yield of the reformed pitch was 100%. Resulting optically isotropic reformed pitch had a softening point of 232° C.

This reformed pitch was heat treated at 400° C. for 2 hours. The resulting pitch was 100% flow type mesophase having a softening point of 270° C. A carbon fiber was conventionally produced by spinning this resulting pitch at 288° C., infusiblizing and carbonizing at 2500° C. This carbon fiber had a tensile strength of 370 kgf/mm$^2$ and a modulus of elasticity of $80\times10^3$ kgf/mm$^2$.

EXAMPLE 12

A petroleum based pitch, as a by-product of F.C.C. of DVGO, having a softening point of 72° C., was heat treated in the nitrogen atmosphere to obtain Pitch A having a mesophase content of 10% and a softening point of 190° C. The heat treatment was further continued to obtain Pitch B having a mesophase content of 100% and a softening point of 278° C.

The optically isotropic reformed pitch of Example 10 (a softening point of 151° C.) was blended to the Pitch A at a ratio of 20 wt % relative to Pitch A. The mixture was heat treated at 400° C. for 2 hours, whereby the resulting pitch had a mesophase content of 90% and a softening point of 262° C.

While, the optically isotropic reformed pitch of Example 10 (a softening point of 151° C.) was blended to the Pitch B at a ratio of 20 wt % relative to Pitch B. The mixture was heat treated at 380° C. for 0.5 hours, whereby the resulting pitch had a mesophase content of 100% and a softening point of 270° C.

Function and Effectiveness of the Invention

This invention relates to a process for producing an optically isotropic reformed pitch useful for various carbon materials by reacting a pitch in the presence of a strong Lewis acid and a co-solvent. Since the said reformed pitch has a characteristic property that it has a high fixed carbon content in spite of its low softening point and low quinoline insoluble content and that it can be converted easily to mesophase by heat treatment, the said reformed pitch can be used for various purposes, for example, an impregnant for high grade carbon materials such as carbon-carbon composite materials, artificial graphite electrodes, carbon-graphite shaped articles, etc., a raw pitch for mesophase pitch based carbon fibers, and a mixing material for modifying various kinds of pitch.

The present invention relates to a process for producing meso-carbon microbeads having a uniform diameter, i.e. a mean diameter in the range of 0.5~20 μm, from a petroleum based pitch or a coal based pitch or a mixture thereof with a high yield of about 60 wt % or more.

Meso-carbon microbeads are spherical carbonaceous materials having a structure in which highly condensed polycyclic aromatic hydrocarbons are arranged in a definite direction. Meso-carbon microbeads have properties inherent to carbon chemically, electrically and magnetically. Since they have good sintering property during carbonization, they can be used for various industrial materials such as an electrically conductive filler, a binderless isotropical high density carbon material, a catalyst carrier, a chromatogram filler and the like. They are used in the form of meso-carbon microbeads as they are produced or after carbonization.

What is claimed is:

1. A process for producing an optically isotropic reformed pitch useful for carbon materials which consists essentially of mixing a pitch having an aromatic carbon ratio fa of more than 0.6, with one Lewis acid selected from the group consisting of anhydrous $AlCl_3$ and $HF.BF_3$ and a co-solvent selected from the group consisting of dichlorobenzene, nitrobenzene and trichlorobenzene in an amount sufficient to dissolve both the said pitch and the said Lewis acid and promote a reaction in the liquid state, so as to give a mol ratio of the said Lewis acid to the said pitch in the range of 0.3–5.0 and a mol ratio of the said co-solvent to the said pitch in the range of 2.5–50, reacting the mixture at a reaction temperature of 100°–300° C., and removing the said Lewis acid and the said co-solvent from the resulting reaction product.

2. A process for producing an optically isotropic reformed pitch useful for carbon materials which consists essentially of mixing a pitch having an aromatic carbon ratio fa of more than 0.6, $HF.BF_3$ and a co-solvent selected from the group consisting of dichlorobenzene, nitrobenzene and trichlorobenzene in an amount sufficient to dissolve both the said pitch and the said $HF.BF_3$ and promote a reaction in the liquid state, so as to give a mol ratio of the said HF, $BF_3$ and co-solvent to the said pitch in the range of 1–5, 0.3–1 and 2.5–50, respectively, reacting the mixture at a reaction temperature of 100°–300° C., and removing the said HF, $BF_3$ and the said co-solvent from the resulting reaction product.

3. A process for producing meso-carbon microbeads which comprises heat treating the optically isotropic reformed pitch produced according to the claim 1 or claim 2 at a temperature of 200°–380° C. to produce optically anisotropic small spheres and separating the produced optically anisotropic small spheres from an optically isotropic matrix.

4. A process for producing a low softening mesophase pitch which comprises mixing a mesophase containing pitch, which is produced from a pitch having an aromatic carbon ratio fa of more than 0.6, with the optically isotropic reformed pitch produced according to the claim 1 or claim 2 and heat treating the said mixture.

5. A process for producing a mesophase pitch based carbon fiber which comprises cheating and spinning the optically isotropic reformed pitch produced according to the claim 1 or claim 2.

* * * * *